United States Patent [19]

Rogers

[11] Patent Number: 4,552,464

[45] Date of Patent: Nov. 12, 1985

[54] ANALOGUE DIAL CALCULATOR/WRIST WATCH

[76] Inventor: Scott A. Rogers, 6510 Patterson Ave., Richmond, Va. 23226

[21] Appl. No.: 631,749

[22] Filed: Jul. 17, 1984

[51] Int. Cl.[4] ..... G04B 47/00

[52] U.S. Cl. ..... 368/10

[58] Field of Search ..... 368/10, 69

[56] References Cited

U.S. PATENT DOCUMENTS

| | | | |
|---|---|---|---|
| 4,120,036 | 10/1978 | Maeda et al. | 368/10 |
| 4,257,115 | 3/1981 | Hatuse et al. | 368/69 |
| 4,268,913 | 5/1981 | Nakagiri et al. | 368/10 |
| 4,300,204 | 11/1981 | Maeda et al. | 368/10 |
| 4,432,652 | 2/1984 | Munekata et al. | 368/69 |

FOREIGN PATENT DOCUMENTS 54-98659 8/1979 Japan .

*Primary Examiner*—Bernard Roskoski

*Attorney, Agent, or Firm*—Cushman, Darby & Cushman

[57] ABSTRACT

The combination analogue face watch and an electronic calculator having a separate digital display wherein the numerical inputs for the calculator lie adjacent and correspond to the hour designations about the analogue watch face. Thus, the watch provides a conceptual transfer of input function keys for a calculator about an analogue dial watch so that the keys serve the dual function of providing the hour designation and identical numerical inputs for the calculator.

9 Claims, 3 Drawing Figures

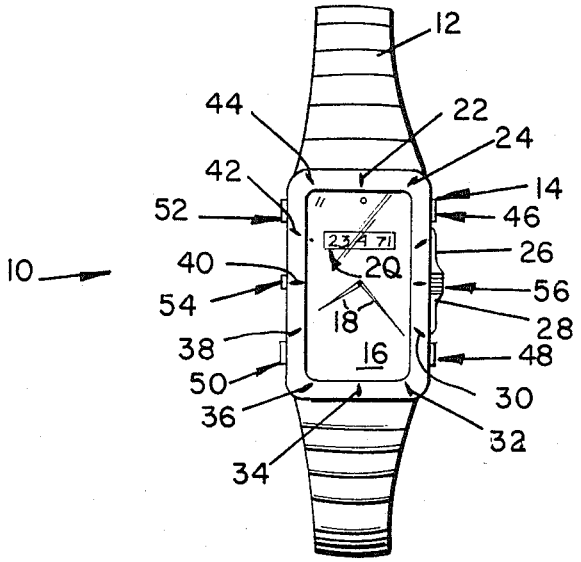
Fig. 1
Fig. 2
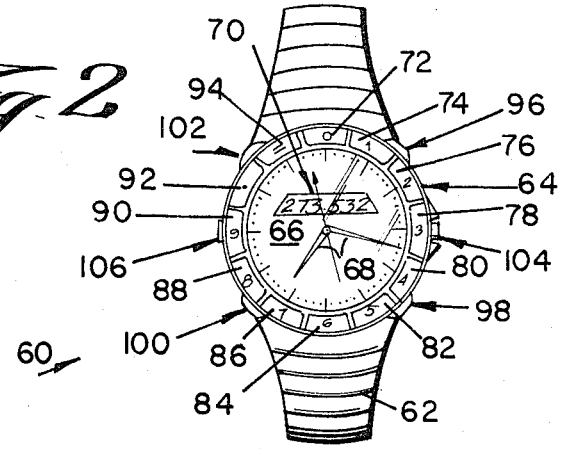
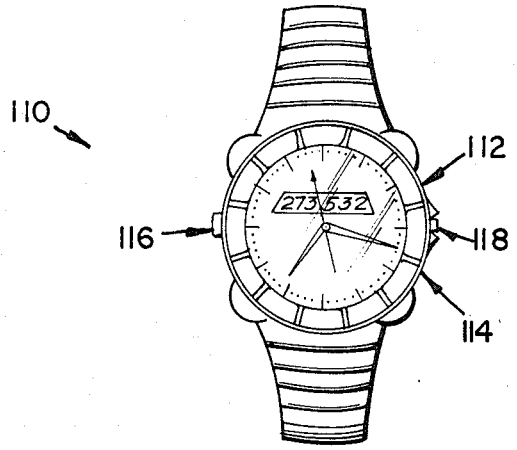
Fig. 3

ANALOGUE DIAL CALCULATOR/WRIST WATCH

FIELD OF THE INVENTION

This invention relates to a wrist watch equipped with an electronic calculator where separate numerical input switches are positioned adjacent or themselves constitute the respective analogue watch face hour designations.

BACKGROUND OF THE PRESENT INVENTION

The concept of a combination calculator-watch is not new and has produced a wide variety of configurations. Most of the various attempts to formulate such a calculator and watch combination have resulted in the use of digital format and a conventional calculator type numerical button layout. Such watches also conventionally employ a visible liquid crystal screen area in which the digits and their manipulation are displayed together with vertical and horizontal rows of numerical input and function buttons arranged adjacent that display. This type of arrangement of columns is shown in U.S. Pat. No. 4,266,278.

Exemplary of additional types of digital watch and integral calculator arrangements, where the calculator function buttons are arranged about the watch housing and about a digital display are shown in Nakamura et al, U.S. Pat. No. 4,055,755, Nakagiri et al, U.S. Pat. No. 4,268,913, and Maeda et al, U.S.Pat. Nos. 4,120,036 and 4,300,204.

In the Maeda et al '036 and '204, and Nakagiri et al '913 patents, a plurality of function buttons are positioned in a generally circular pattern about a display and on the front of the watch case housing. In Maeda et al, eighteen separate inputs are arranged about the watch face. Four inputs are arranged across the top and bottom of the display with five inputs separately arranged on each side. The function buttons for addition, subtraction, multiplication and division are positioned across the top of the watch housing above the display with the equal and day function buttons, together with the zero, one and two inputs being on the right hand side. The clear entry, decimal point, nine, eight and seven buttons are located on the left hand side of the display and the three, four, five and six numeral buttons are located across the bottom of the display.

In Nakagiri et al ('913), twenty-two separate inputs are arranged around the display. At the very top of a switch 80-1 is used to switch between a calendar and a time display functions. From one o'clock down to four o'clock, function buttons are provided corresponding to square root, division, times, minus, plus, equals and a decimal point. A button corresponding to the numeral one is positioned adjacent the nine o'clock position and a button corresponding to numeral zero lies adjacent five o'clock with the remaining numerals extending in ascending order from nine o'clock to five o'clock or in a counterclockwise arrangement relative to clockwise hour designations. Additional function buttons then extend from ten o'clock to eleven o'clock.

In Nakamura et al ('755), a digital display is provided in the center of the watch face and positioned thereabout are a plurality of touch electrodes, thirteen in number. The patent does not indicate what particular items or inputs are dedicated to each touch electrode and a separate mode switch is provided in the side wall of the watch frame for selecting between time and calculation operations.

In Tanaka et al ('004), a waterproof terminal arrangement is disclosed and in FIG. 4, a plurality of function switches are again provided about a circular digitized display. The zero input button is located adjacent the normal nine o'clock position with buttons for numerals 1–9 thereafter extending in a counterclockwise fashion around to a position for numeral 9 located approximately at the three o'clock position. The remaining arc about the watch includes function buttons for plus, minus, divide, square root, log and cancel inputs.

SUMMARY OF THE PRESENT INVENTION

The present invention comprises a combination of a watch and calculator wherein the watch itself is provided with an analogue dial face. The shape of the face is unimportant and can either be oval, round, square or some other convenient shape depending upon the desire of the designer. The designation of the hours can be according to either a twelve or twenty-four hour clock arrangement, but in an analogue style. A twelve hour face will have the hour designations uniformly spaced apart by a 30° angle, while with a twenty-four approach hour, the hour designations are separated by a 15° angle. The numerical inputs in this invention are preferably in the form of buttons that also constitute the hour designations arranged about the dial face, for example, on a twelve hour clock so that the button at the top is a zero, corresponding to the twelve o'clock position. Thereafter, the button corresponding to numeral one is located at the normal one o'clock position, the button for numeral two is at the two o'clock position and so on about the dial face through nine numerals. At the ten, eleven and twelve o'clock positions, the decimal, zero, and equals buttons can be located with one being at the ten o'clock position, one being at the eleven o'clock position, and one being at the twelve o'clock position, it not being important which one is at which position other than for design purposes. By arranging the clock face in this manner, the hour designations are conveniently provided and the 30° separation permits use of sufficiently sized buttons for easy calculator operation by one's fingers. By trying to put too many buttons around or on a clock face often times the buttons themselves become extremely small so that one cannot operate the calculator by use of one's finger, but rather only by employing the point of a pencil or some other small instrument. By my arrangement for the buttons corresponding to the numerical input keys required for the calculator, they serve the dual purpose of providing the hour designation and calculator key values. This permits a wide variety in design capabilities not achieveable with prior arrangements certainly not by those referred to above, and provides sufficiently large buttons so that one can easily operate all of the buttons with a finger. In addition, by arranging the numerical buttons directly adjacent the hour designations, it is possible to entirely omit the numbers from the face of the buttons, again enhancing design capabilities for watch designers, since an operator of the watch will know precisely the value of each numerical button because of its position adjacent the hour designation.

Alternatively, a plain watch face can be used or a variety of other types of hour designation symbols, such as single dots or Roman numerals could be used, with plain numerical buttons still positioned adjacent their respective hours. This creates still further design capabilities.

Other objects, features, and characteristics of the present invention as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 1 is a front, plan view of a watch according to the present invention having a rectangular face and employing small, widely spaced buttons;

FIG. 2 is a front, plan view of a watch according to the present invention wherein the watch face is circular and the calculator buttons include numerals on their face and are positioned at standard analogue watch face positions;

FIG. 3 is a front, plan view of watch face according to the present invention wherein the watch face is circular and wherein numerical designations have been omitted from the face of the buttons.

DETAILED DESCRIPTION OF THE PREFERRED EXEMPLARY EMBODIMENTS

Turning now to the FIGURES, and with reference first to FIG. 1, electronic watches with integral calculators are known such as in the aboveidentified patents, wherein watches and the necessary circuitry are set forth, which information with respect to the construction and operation of such watches is hereby incorporated by reference. In addition, attention may also be directed to Lowdenslager, U.S. Pat. No. 4,022,014; Laesser, U.S. Pat. No. 4,044,242; Reese, U.S. Pat. No. 3,803,834 and Sekiya et al, U.S. Pat. No. 4,277,840, which also relate to wrist watch calculators in combination with watches and electronic time pieces. The material from these patents respecting watch constructions and the associated calculator circuitry is also hereby incorporated by reference. Accordingly, further description of such watch and calculator circuitry is not believed to be essential, the same not forming a part of this invention.

With reference to FIG. 1, a watch according to the present invention, generally indicated at 10, is comprised of a strap or band 12, a watch case or housing, generally indicated 14, on which a plain dial 16 is mounted together with the usual hands 18 and a liquid crystal display 20 used for the calculator. Located about the periphery are a plurality of buttons 22–44 which respectively correspond to hour designations and numerical input data as follows:

| Button | Numerical Input Data | Hour Designation |
|---|---|---|
| 22 | 0 | 12 |
| 24 | 1 | 1 |
| 26 | 2 | 2 |
| 28 | 3 | 3 |
| 30 | 4 | 4 |
| 32 | 5 | 5 |
| 34 | 6 | 6 |
| 36 | 7 | 7 |
| 38 | 8 | 8 |
| 40 | 9 | 9 |
| 42 | . (decimal point) | 10 |

-continued

| Button | Numerical Input Data | Hour Designation |
|---|---|---|
| 44 | = (summation) | 11 |

It should be noticed that buttons 22–44 are spaced around the periphery of the watch face 16 so as to be spaced apart by a 30° angle, this corresponding to the watch face being divided up into the twelve segments. These buttons, while small, are separated by relatively wide spaces so that it is very easy for one to use a finger to push only the desired button without fear of pushing the wrong button or more than one simultaneously.

Button 22 provids a zero input and also constitutes the twelve o'clock designation on the watch face. Buttons 23–40 correspond to the remaining numerical values 1–9, each being located at or adjacent the appropriate hour designation position (that is, 1 next to one o'clock, 2 next to two o'clock, etc.).

Button 42 at the ten o'clock position provide a decimal point input function and as indicated, a decimal point designation can be shown on the dial face. Button 44 provides the summation or equals function at the eleven o'clock position and again and equals designation can be provided on the dial face.

Button 24 at the one o'clock hour designation will be understood by a user of the watch and the calculator to represent the number 1 for both purposes. Thus, the hour hand in FIG. 1 clearly points to eight o'clock, button 38, and toward numeral 8.

Additional buttons or keys 46–52 correspond to times, divide, plus and minus functions respectively. Button 54 located on the outside edge adjacent the nine o'clock position provides clear and/or mode selection functions while knob 56 represents the hour/minute hand winder.

FIG. 2 shows another watch exemplary of the present invention, generally indicated at 60, and is also comprised of a belt or band 62, a watch case 64, a dial 66, hands 68 and a conventional digital display, generally indicated at 70. The configuration shown in FIG. 2 includes a circular face 66 about which function buttons 72–94 are arranged so that the following relationships exist:

| Button | Numerical Input Data | Hour Designation |
|---|---|---|
| 72 | 0 | 12 |
| 74 | 1 | 1 |
| 76 | 2 | 2 |
| 78 | 3 | 3 |
| 80 | 4 | 4 |
| 82 | 5 | 5 |
| 84 | 6 | 6 |
| 86 | 7 | 7 |
| 88 | 8 | 8 |
| 90 | 9 | 9 |
| 92 | . (decimal point) | 10 |
| 94 | = (summation) | 11 |

Buttons 96, 98, 100 and 102, respectively, provide multiplication, division, addition and substraction functions as was true with watch 10 shown in FIG. 1, it not being important which function is at which position other than for design purposes. Numeral 104 refers to a conventional time/hand setting unit and button 106 provides clear and/or mode selection functions.

Buttons 72–94 include a visible numeral function designation. Thus, buttons 1, 2, 3, 4, 5, 6, 7, 8 and 9 provide the hour designations associated with their position on the watch face and the identical numerical input data for the calculator. This is to be contrasted with the embodiment shown in FIG. 3, generally indicated at 110, where the buttons such as at 112 and 114 do not include any visible numeral indicia, Button 112, however, still clearly corresponds to numeral 2 and the two o'clock hour designation while button 114 corresponds to numeral 4 and four o'clock. In the FIG. 3 embodiment, the appropriate mode selection buttons, such as at 116, are also included, as well as the time set mechanism as at 118.

Thus, the present invention provides a watch calculator that shows "time" in a normal analogue way together with the addition of a digital readout for the calculator or other mode portion of the device, the numerical inputs to all modes being provided by buttons or keys spaced around the face adjacent to the numbers that they normally correspond to with respect to analogue time functions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures.

What I claim is:

1. A calculator watch having an analog dial face including a watch housing, calculator means for performing numerical calculations, said watch having analog hour designations positioned uniformly about said dial face, said calculator means including numerical input means for the numerals zero through nine, for entering like numerical data into said calculator means, said numerical input means for numerals one through nine being positioned adjacent their respective identical numerical hour designations about said analog watch face and a zero numerical input means positioned adjacent either the ten o'clock, eleven o'clock or twelve o'clock positions on said analog watch face.

2. A calculator watch as in claim 1, wherein said watch includes a twelve hour analogue face and said numerical input means are positioned, relative to one another, 30° apart about said watch starting at the twelve o'clock position.

3. A watch as in claim 2, wherein said numerical input means also constitute said hour designations.

4. A watch as in claim 1, wherein said watch includes a twenty-four hour analogue face and the hour designations therefor and wherein said numerical input means are positioned, relative to one another, 15° apart about said watch starting at the twelve o'clock position.

5. A watch as in claim 1 wherein said calculator means further includes decimal input means for inputting decimal data and summation input means for inputting a summation command, said decimal point and summation input means being respectively positioned adjacent either the unused, ten, eleven or twelve o'clock hour designations so that there is a combined relationship at those positions together with the zero input means.

6. A watch as in claim 5, wherein said calculator means further includes function control means for regulating the functioning of said calculator means, said function control means being positioned on said watch housing.

7. A watch as in claim 6, wherein said numerical input means also constitute said hour designations.

8. A watch as in claim 7, wherein said numerical input means comprises depressible buttons.

9. A calculator watch as in claim 1 further including mode selection input means and wherein said numerical input means further provide numerical inputs to all modes.

* * * * *